US005161453A

United States Patent [19]

Yared et al.

[11] Patent Number: 5,161,453

[45] Date of Patent: Nov. 10, 1992

[54] ACTUATION AND FLOW CONTROL FOR A VALVE

[75] Inventors: Linda S. Yared; Mark P. Cencelewski, both of South Bend, Ind.

[73] Assignee: Allied-Signal Inc., Morristown, N.J.

[21] Appl. No.: 744,846

[22] Filed: Aug. 14, 1991

[51] Int. Cl.[5] ..... F15B 9/10

[52] U.S. Cl. ..... 91/376 R; 92/98 R

[58] Field of Search ..... 91/369.1, 369.2, 376 R; 92/48, 98 R, 96, 99

[56] References Cited

U.S. PATENT DOCUMENTS

| | | | |
|---|---|---|---|
| 3,316,816 | 5/1967 | Yardley | 91/376 R |
| 4,622,882 | 11/1986 | Bischoff et al. | 91/369.1 |
| 4,756,232 | 7/1988 | Thioux et al. | 91/369.2 |
| 4,784,038 | 11/1988 | Gautier | 91/369.2 |
| 5,076,142 | 12/1991 | Steer et al. | 91/369.3 |

FOREIGN PATENT DOCUMENTS

| | | | |
|---|---|---|---|
| 1393529 | 5/1975 | United Kingdom | 92/48 |

*Primary Examiner*—Edward K. Look
*Assistant Examiner*—Hoang Nguyen
*Attorney, Agent, or Firm*—Leo H. McCormick, Jr.; Ken C. Decker

[57] ABSTRACT

A method of establishing a spring force for a push rod of a control valve in a brake booster to set the force which opposes an operational input force. After attaching the push rod to a plunger, the plunger is located in the bore of a hub of a movable wall of the brake booster. When the plunger is installed in the bore, a groove located adjacent a threaded end of the push rod extends past the hub. A spring and sleeve are placed on the push rod and a fixture attached to the rear shell of the booster. The push rod and sleeve pass through an opening in the fixture to align the push rod within the axial center of the bore of the hub. A force is applied to the push rod to move the push rod within said bore to establish a rest position of the plunger with respect to a seat on a poppet valve. Thereafter, a force is applied to the sleeve to initially move the sleeve on said push rod to bring the spring into engagement with the hub and thereafter compress the spring until a predetermined spring force is established. When the desired spring force is achieved, a radial force is applied to the sleeve to create detents. The detents are located in the groove in the push rod to retain the spring in this compressed condition. Thereafter, the fixture is removed from the rear shell and an eye member attached to the threaded portion of the push rod. During a brake application, the input force from an operator must overcome spring force before the plunger moves to allow operational fluid to flow past the seat. The plunger has a plurality of axial projections that direct substantially turbulent free flow of operational fluid to a passage connected to a chamber where a pressure differential develops across a wall to create an output force corresponding to the input force.

2 Claims, 1 Drawing Sheet

ACTUATION AND FLOW CONTROL FOR A VALVE

This invention relates to a method of establishing a spring force for a Push rod and plunger in a brake booster. A sleeve of the push rod is moved to compress a return spring while the push rod holds the plunger in a stationary position with respect to a seat of the control valve. The spring force must be overcome to move the plunger and effect a brake application.

Brake boosters are normally manufactured on an assembly line by building up Parts until a completed assembly is achieved. The operational characteristics of the assembled brake booster are evaluated with respect to a standard for acceptability. U.S. Pat. No. 4,268,945 illustrates such a method of sequentially assembling a brake booster.

U.S. patent application Ser. No. 693,983 illustrates a method of evaluating a brake booster during assembly by measuring the projected output force with respect to a standard and if necessary modifying the reaction forces in order for the output to be in conformance with the standard.

In evaluating of the operation of various brake boosters, it was determined that the actuation force required to effect a brake application was not always the same. Analysis of the actuation force indicated that the spring force on the plunger of the various brake boosters was a primary cause in the non-uniform actuation forces. In such brake boosters, the return spring was caged between a shoulder on the push rod and a poppet retainer fixed to the hub of the movable wall in the brake booster. Should either the shoulder be located at the wrong place or the dimension of the poppet retainer or spring be out of tolerance, the resulting spring force could be adversely affected and thus result in non-uniform actuation forces from brake booster to brake booster.

This invention discloses a method of establishing a spring force for a push rod of a control valve in a brake booster which opposes an operational input force in accordance with preset operational standards. In the manufacture of a brake booster, after the push rod is attaching to a Plunger, the plunger is located in the bore of a hub of a movable wall already assembled in the brake booster. When the plunger is installed in the bore, a groove located adjacent a threaded end of the push rod extends past the hub. A spring and sleeve are placed on the push rod and a fixture attached to the rear shell of the brake booster. The push rod and sleeve pass through an opening in the fixture to align the push rod within the axial center of the bore of the hub. A first force is applied to the hub to position the wall in the rest position and a second force is applied to the push rod to move the push rod within the bore to establish a rest position for the plunger with respect to a seat on a poppet valve. Thereafter, a third force is applied to the sleeve to initially move the sleeve on said push rod and bring the spring into engagement with the hub and thereafter to compress the spring until a predetermined spring force is established. When this desired spring force is achieved, a radial force is applied to the sleeve to create detents. The detents are located in the groove in the push rod to retain the spring in this compressed condition. Thereafter, the fixture is removed from the rear shell and an eye member attached to the threaded portion of the push rod. During a brake application, the input force from an operator must overcome the spring force before the Plunger moves to allow operational fluid to flow Past the seat. The plunger has a plurality of axial Projections that direct substantially turbulent free flow of operational fluid to a passage connected to a chamber where a pressure differential develops across a wall to create an output force corresponding to the input force.

It is an object of this invention to provide a method of setting force for a return spring in order to establish an actuation force required to effect a brake application.

It is another object of this invention to provide a brake booster with an actuation member having a plunger, push rod, and adjustable return spring to establish an actuation force required to effect a brake application.

It is a further object of this invention to provide a brake booster with plunger having a plurality of rearward projections that help to maintain a push rod in the axial center of a bore.

It is a further object of this invention to provide a brake booster with a push rod having an adjustable sleeve with tangs which absorb radial force to prevent damage to the hub of a brake booster.

These objects and the advantages offered by this invention should be apparent from reading this invention while viewing the drawings where:

Figure 2:
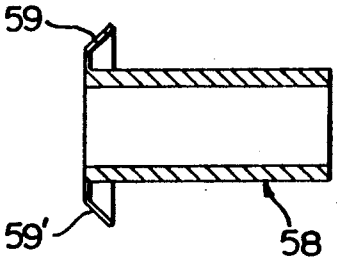
FIG. 2 is a sectional view of the adjustable sleeve of the actuation member of FIG. 1.
Figure 3:
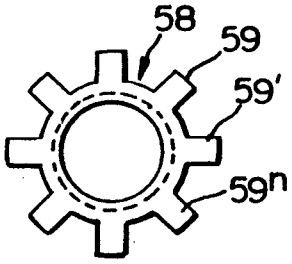
FIG. 3 is an end view of the adjustable sleeve of FIG. 2.
Figure 4:
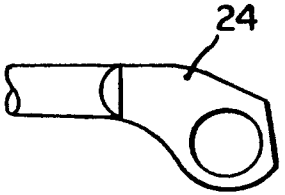
FIG. 4 is a schematic illustration of the eye member for the push rod of FIG. 1.
Figure 1:
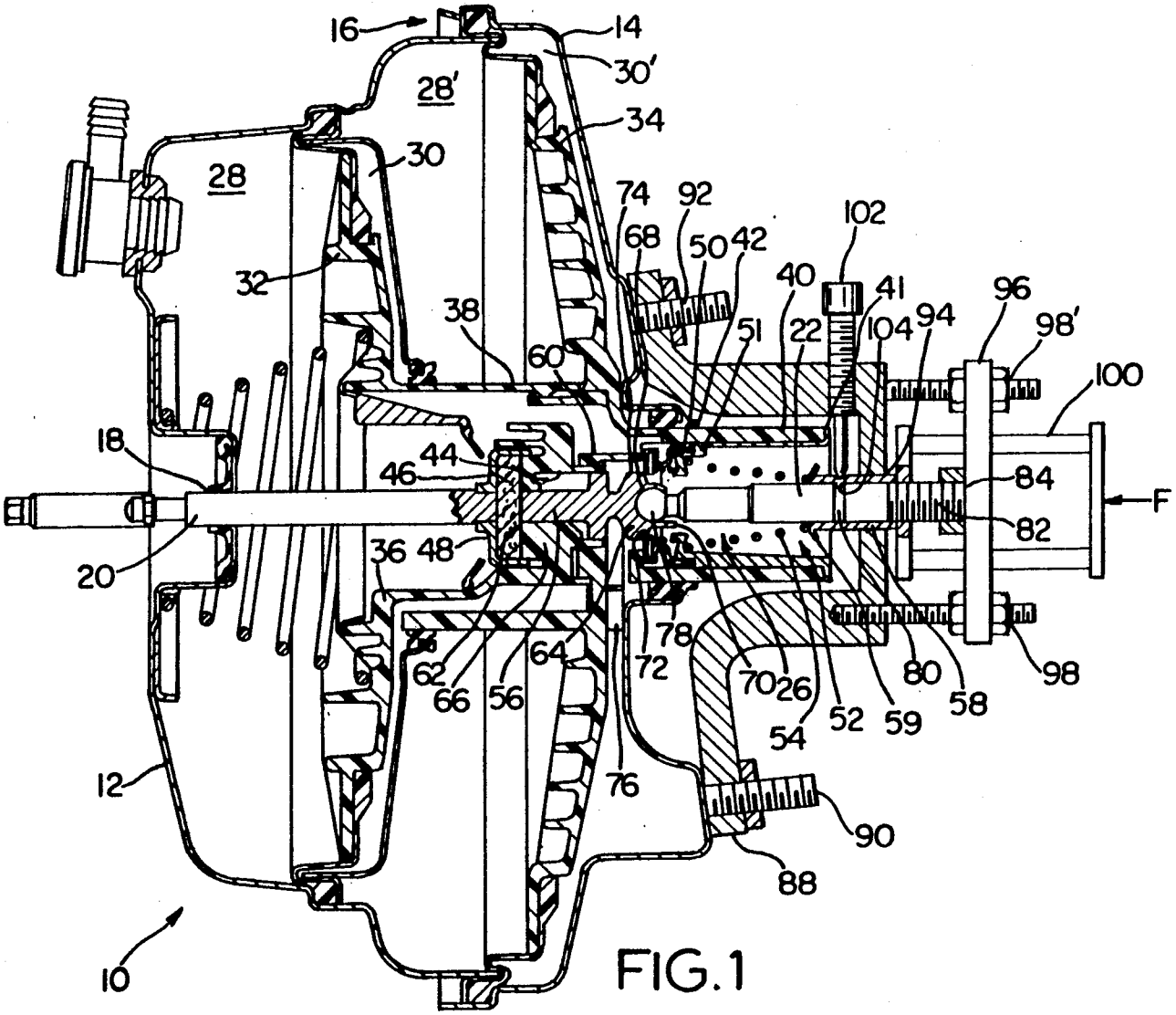
FIG. 1 is a schematic illustration of a brake booster showing an actuation member having an adjustable control valve return spring made according to the principals of this invention.

The servomotor 10 shown in FIG. 1 has a housing formed by joining a front shell 12 to a rear shell 14 through a lance means 16 to form a sealed cavity. The front shell 12 has an axial opening 18 through which a push rod 20 extends to supply a master cylinder (not shown) with an operational force in response to an input force applied from a brake pedal (not shown) through eye connection 24, see FIG. 4, to move to push rod 22 which activates a control valve 26.

The interior of servomotor 10 is divided into front 28,28' and rear 30,30' chambers by walls 32 and 34, of the type fully disclosed in U.S. Pat. No. 5,076,142 which extend from cylindrical body 36 and hub 38, respectively. Hub 38 has a rear projection 40 that extends through opening 42 in shell 14. Projection 40 has a bore 44 which houses control valve 26, reaction disc 46 head 48 on push rod 20, poppet member 50 and actuation member 52.

Actuation member 52 includes push rod 22, return spring 54, plunger 56 and an adjustable sleeve 58 for setting the spring force in return spring 54. Plunger 56 has a cylindrical body 60 with a first end 62 located adjacent reaction disc 46 and a second end 64. The first end 62 is located on a bearing surface 66 on hub 38 to position the second end 64 substantially on axial center of bore 44. Cylindrical body 60 has an axial opening 68 that extends from the second end 64 toward said first end 62. The cylindrical body 60 has axial projections 70 that extend from the second end 64 and a frusco-conical surface 72 that extends from a peripheral surface 74 toward axial projection 70, 70' . . . 70 ". The frusco-conical surface 72 forming an atmospheric seat for the poppet member 50. Cylindrical member 60 has a slot for the retention of key member 76 of the type disclosed in U.S. Pat. No. 4,953,446.

Push rod 22 has a first end with a spherical head 78 which is retained in said axial opening 68 of cylindrical member 56 by forming or staking a portion of the axial projection 70, 70' . . . 70'' around spherical head 78. Push rod 22 which is substantially cylindrical from the spherical head 78 to the second end 84 has a groove 80 located adjacent a threaded section 82.

Return spring 54 has a first end which is fixed in bore 44 of hub 38 by retainer 51 of poppet member 50 and a second end that surrounds push rod 22. Sleeve 58 which is initially loosely located on push rod 22 has a flange or plurality of tangs 59, 59'. . . $59^N$, as best shown in FIG. 5 that engage the second end of return spring 54. Tangs 59, 59'. . . $59^N$ are designed to engage the interior of the hub and absorb radial forces that may be imposed on Push rod 22 to prevent damage to projection 40.

During assembly, after push rod 22 is attached to plunger 56 by axial Projections 70, 70'. . . $70^N$ and plunger 56 is retained in bore 44 by key member 76, groove 80 on push rod 22 is located in a plane adjacent the end 41 of Projection 40 and the threaded surface 82 on end 84 extends past end 41. Return spring 54 and sleeve 58 are sequentially placed on push rod 22 prior to attaching fixture 88 to rear shell 14 by mounting bolts 90 and 92. Fixture 88 has an opening 94 and push rod 22 and sleeve 58 extending through this opening 94. Fixture 88 aligns the Push rod 22 and sleeve 58 within the axial center of bore 44. End 84 on push rod 22 is attached to an end plate 96 which extends from fixture 88. End plate 96 can be adjusted by turning bolts 98, 98' to move push rod 22 within bore 44 to establish the rest Position of said plunger 56 with respect to the vacuum seat 52 on hub 38 and the atmospheric seat formed on the face on poppet member 50. Under some circumstances, it may be necessary to apply an axial counter force to push rod 20 to hold plunger 56 stationary to aid in the establishment of its rest position in bore 44. When the rest position is established, a force F is applied to linkage 100 to initially move sleeve 58 on push rod 22 to bring the first end of spring 54 into engagement with retainer 51 located in projection 40 of hub 38 and thereafter compress spring 58 until a predetermined spring force is established.

When the desired or predetermined spring force is obtained, a radial force is applied through bolt 102 either by a hydraulic ram or simply by screwing bolt 102 into fixture 88 to create detents 104 on sleeve 58 which are located in groove 80 in push rod 22 to retain or cage return spring 54 in this compressed condition.

Fixture 88 is removed from the rear shell 14 and eye member 24 is attached to the threaded section 82 of the push rod 22 to complete the assembly of brake booster 10.

During a brake application, an input force is applied to eye member 24 by a brake pedal. After the spring force of spring 54 is overcome, Push rod 22 moves plunger 56 from its rest position to an actuation position to allow operational fluid to flow Past atmospheric seat on poppet 50 through passage 55 to the rear chambers 30, 30'. The axial projections 70, 70'. . . $70^N$ that extend from plunger 56 form a smooth flow guide such that turbulence is substantially eliminated in the flow. With operational fluid in chambers 30, 30' and vacuum in chambers 28, 28' pressure differential develops across a walls 32 and 34 to create an output force corresponding to the input force. During a brake application, should the input force move the push rod 22 from the axial alignment with the output push rod 20, tangs 59, 59'. . . $59^N$ engages retainer 51 and absorbs the radial force component to prevent damaging the rear projection 40 of hub 38.

I claim:

1. In a brake booster having an actuation member for moving a control valve in a bore of a cylindrical projection that extends from a hub of a movable wall in the brake booster, said actuation member responding to an input force for moving said control valve from a rest position to an actuation position to allow operational fluid to flow past a seat in said bore without turbulence and through a passage in said hub to communicate air to a chamber where a pressure differential develops across said movable wall to create an output force corresponding to said input force, the improvement in the actuation member comprising:

a plunger having a cylindrical body with a first end and a second end, said first end being located on a bearing surface in said hub and a second end that extends into said bore of said cylindrical projection, said cylindrical body having an axial opening that extends from said second end toward said first end, said cylindrical body having a plurality of axial projections that extend from said second end and a frusco-conical surface that extends from a first diameter surface toward the plurality of axial projections;

a push rod having a first end with a spherical head resiliently retained in said axial opening of said cylindrical member by said plurality of axial projections and a second end with a groove located adjacent a threaded section;

a spring located in said bore with a first end that engages said cylindrical body and a second end that surrounds said push rod; and a sleeve located on said push rod having a flange that retains said second end of said spring, said sleeve having a plurality of detents that are located in said groove to establish the spring force that resists said input force; said flange having a plurality of radial tangs for engaging said hub to absorb any radial forces that may be transmitted to said push rod by said input force to prevent damage to said cylindrical projection.

2. The brake booster as recited in claim 1 wherein a portion of said plurality of axial projections on said plunger engage said push rod to limit the radial movement of the second end of said push rod within said bore and aid in reducing said radial forces that may develop in response to an input force.

* * * * *